US009643074B2

(12) United States Patent
Barnes

(10) Patent No.: US 9,643,074 B2
(45) Date of Patent: May 9, 2017

(54) WHEELED SKI

(71) Applicant: Jacob Barnes, Park City, UT (US)

(72) Inventor: Jacob Barnes, Park City, UT (US)

(73) Assignee: Jacob Barnes, Park City, UT (US)

( * ) Notice: Subject to any disclaimer, the term of this patent is extended or adjusted under 35 U.S.C. 154(b) by 0 days.

(21) Appl. No.: 14/668,903

(22) Filed: Mar. 25, 2015

(65) Prior Publication Data

US 2016/0279504 A1 Sep. 29, 2016

(51) Int. Cl.
*A63C 5/035* (2006.01)
*A63C 17/22* (2006.01)
*A63C 17/04* (2006.01)

(52) U.S. Cl.
CPC ..... *A63C 5/035* (2013.01); *A63C 17/045* (2013.01); *A63C 17/226* (2013.01)

(58) Field of Classification Search
CPC ..... A63C 5/035; A63C 17/226; A63C 17/064; A63C 17/045
See application file for complete search history.

(56) References Cited

U.S. PATENT DOCUMENTS 3,365,208 A * 1/1968 Blanchard ..... 280/842
3,389,922 A * 6/1968 Eastin ..... 280/842
3,891,225 A 6/1975 Sessa
4,738,456 A * 4/1988 Creason ..... 280/842
4,768,793 A * 9/1988 Spencer ..... 280/842
4,886,298 A * 12/1989 Shols ..... 280/842
4,892,332 A * 1/1990 Jennings ..... 280/842
4,898,403 A * 2/1990 Johnson ..... 280/842
5,195,781 A * 3/1993 Osawa ..... 280/842
5,251,934 A * 10/1993 Gates ..... 280/842
5,312,120 A * 5/1994 Wiegner ..... 280/11.212
5,372,383 A 12/1994 Kubierschky
(Continued)

FOREIGN PATENT DOCUMENTS

FR 2862232 A1 * 5/2005 ..... A63C 17/06
WO 02/40114 A2 5/2002
WO 2005/115567 A1 12/2005

OTHER PUBLICATIONS

International Search Report and Written Opinion mailed Jun. 3, 2016, as received in Application No. PCT/US2016/022317 (11 pages).

*Primary Examiner* — Hau Phan
*Assistant Examiner* — Jacob Meyer
(74) *Attorney, Agent, or Firm* — Brian Lance Jensen

(57) ABSTRACT

A wheeled ski is disclosed that may include a flexible member. The wheeled ski may also include a first wheel assembly that includes a first wheel with a first-wheel first rotational axis and a first-wheel second rotational axis. The first-wheel first rotational axis and the second-wheel second rotational axis may intersect. The wheeled ski may also include a second wheel assembly that includes a second wheel with a second-wheel first rotational axis and a second-wheel second rotational axis. The second-wheel first rotational axis and the second-wheel second rotational axis may intersect. The first wheel assembly may further include a first axle coupled with the flexible member and a first rod that extends through the first axle. The second wheel assembly may further include a second axle coupled with the flexible member and a second rod that extends through the second axle.

18 Claims, 9 Drawing Sheets

(56) References Cited

U.S. PATENT DOCUMENTS

| | | | | |
|---|---|---|---|---|
| 5,441,286 | A * | 8/1995 | Pozzobon | 280/11.27 |
| 5,673,941 | A * | 10/1997 | Osawa | 280/842 |
| 5,901,981 | A * | 5/1999 | Lucht | 280/842 |
| 6,241,264 | B1 * | 6/2001 | Page | 280/11.19 |
| 6,254,113 | B1 * | 7/2001 | Dornan | 280/87.042 |
| 6,425,587 | B1 * | 7/2002 | Moon | 280/11.206 |
| 6,543,791 | B1 * | 4/2003 | Lee | 280/11.223 |
| 6,592,129 | B1 * | 7/2003 | Gates | 280/11.204 |
| 6,832,765 | B1 * | 12/2004 | Walton | 280/11.221 |
| 7,172,205 | B1 * | 2/2007 | Vujtech | 280/87.021 |
| 7,478,803 | B2 * | 1/2009 | Lee | 267/293 |
| 7,784,833 | B2 * | 8/2010 | Tsuchie | 280/842 |
| 8,226,096 | B2 | 7/2012 | Reyes, Jr. | |
| 8,360,475 | B2 * | 1/2013 | Cristiano | 280/842 |
| 8,777,240 | B2 * | 7/2014 | Edginton | 280/87.042 |
| 8,870,193 | B2 * | 10/2014 | Kowalski | 280/11.223 |
| 8,915,506 | B2 * | 12/2014 | Piaceski et al. | 280/87.042 |
| 9,138,632 | B2 * | 9/2015 | Edginton | |
| 2002/0125659 | A1 * | 9/2002 | Page et al. | 280/11.211 |
| 2002/0135141 | A1 * | 9/2002 | Ouellette | 280/7.14 |
| 2002/0195788 | A1 * | 12/2002 | Tierney et al. | 280/87.042 |
| 2008/0296854 | A1 * | 12/2008 | Gates | 280/11.25 |
| 2009/0206572 | A1 * | 8/2009 | Cole | 280/87.042 |
| 2010/0084846 | A1 * | 4/2010 | Edginton | 280/842 |
| 2011/0109053 | A1 * | 5/2011 | Peruffo | 280/11.207 |
| 2012/0104708 | A1 * | 5/2012 | Cristiano | 280/11.232 |
| 2012/0126523 | A1 * | 5/2012 | Langer | 280/842 |

* cited by examiner

WHEELED SKI

SUMMARY

A wheeled ski is disclosed that includes a flexible member having a longitudinal axis, a front portion with respect to the longitudinal axis, and a rear portion with respect to the longitudinal axis. The wheeled ski may include a first wheel assembly. The first wheel assembly may include a first wheel, a first axle coupled with the flexible member, a first bearing coupled with the first wheel that has a first inner race and a first outer race, and a first rod that extends through an opening in the first axle and is coupled with the first bearing. The first wheel may rotate about an axis aligned with the first rod. The first outer race may rotate with the first wheel about a first-wheel spin axis. The first axle may extend through the first inner race.

The wheeled ski may also include a second wheel assembly. The second wheel assembly may include a second axle coupled with the flexible member, a second bearing coupled with the second wheel that has a second inner race and a second outer race, and a second rod that extends through an opening in the second axle and is coupled with the second bearing. The second wheel may rotate about an axis aligned with the second rod. The second outer race may rotate with the second wheel about a second-wheel spin axis. The second axle may extend through the second inner race.

The first wheel assembly may be attached to the front portion of the flexible member, and the second wheel assembly may be attached to the rear portion of the flexible member. The wheeled ski may also include a first aperture within the flexible member and a second aperture within the flexible member. The first wheel assembly may be disposed within the first aperture, and the second wheel assembly may be disposed within the second aperture.

The first axle and the second axle may be coupled to a surface of the flexible member. An angle of the first rod with respect to a ground surface in contact with the first wheel may change in response to the flexible member being flexed. An angle of the second rod with respect to a ground surface in contact with the second wheel may change in response to the flexible member being flexed. An angle of the first rod with respect to the first axle may remain constant when the flexible member is flexed. An angle of the second rod with respect to the second axle may remain constant when the flexible member is flexed.

The first wheel assembly may further include one or more first bushings disposed between the first axle and the first inner race. The first rod may extend through at least one of the one or more first bushings. The second wheel assembly may further include one or more second bushings disposed between the first axle and the first inner race. The second rod may extend through at least one of the one or more second bushings.

The first wheel may rotate about the axis aligned with the first rod until the first inner race or a first spacer element coupled to the first rod contacts the first axle, preventing the first wheel from further rotation about the axis aligned with the first rod. Similarly, the second wheel may rotate about the axis aligned with the second rod until the second inner race or a second spacer element coupled to the second rod contacts second the axle, preventing the second wheel from further rotation about the axis aligned with the second rod. The first wheel and the second wheel may have generally spherical profiles.

A wheeled ski is disclosed that may include a flexible member. The wheeled ski may also include a first wheel assembly that includes a first wheel with a first-wheel first rotational axis and a first-wheel second rotational axis. The first-wheel first rotational axis and the second-wheel second rotational axis may intersect. The wheeled ski may also include a second wheel assembly that includes a second wheel with a second-wheel first rotational axis and a second-wheel second rotational axis. The second-wheel first rotational axis and the second-wheel second rotational axis may intersect.

The first-wheel first rotational axis and the first-wheel second rotational axis may intersect perpendicularly. Also, the second-wheel first rotational axis and the second-wheel second rotational axis may intersect perpendicularly. The first wheel assembly may further include a first axle coupled with the flexible member and a first rod that extends through the first axle. The first-wheel second rotational axis may be aligned with the first rod. The second wheel assembly may further include a second axle coupled with the flexible member and a second rod that extends through the second axle. The second-wheel second rotational axis may be aligned with the second rod. The first axle may be disposed generally perpendicularly to a longitudinal axis of the flexible member and may be fixed to the flexible member. The second axle may be disposed generally perpendicularly to a longitudinal axis of the flexible member and may be fixed to the flexible member. The first axle may extend across a first aperture in the flexible member, and the second axle may extend across a second aperture in the flexible member.

An angle of the first rod with respect to the first axle may remain constant when the flexible member is flexed, and an angle of the second rod with respect to the second axle may remain constant when the flexible member is flexed.

The wheeled ski may further include a first bearing coupled with the first wheel that has a first inner race and a first outer race, and a second bearing coupled with the second wheel that has a second inner race and a second outer race. The first wheel may rotate about the first-wheel second rotational axis until the first inner race or a first spacer element coupled to the first axle contacts the first axle, preventing the first wheel from further rotation about the first-wheel second rotational axis aligned with the first rod. Also, the second wheel may rotate about the second-wheel second rotational axis until the second inner race or a second spacer element coupled to the second axle contacts the second axle, preventing the second wheel from further rotation about the second-wheel second rotational axis aligned with the second rod.

The first rod may extend through the opening in the first axle in a slip-fit manner, and the second rod may extend through the opening in the second axle in a slip-fit manner. The first wheel may rotate at least one full rotation about the first-wheel first rotational axis. The first wheel may have limited rotation about the first-wheel second rotational axis. The second wheel may rotate at least one full rotation about the second-wheel first rotational axis. The second wheel may have limited rotation about the second-wheel second rotational axis.

A wheeled sports device is disclosed that includes a first wheel assembly with a first wheel, a first axle, a first bearing coupled with the first wheel that has a first inner race and a first outer race, and a first rod extending through an opening in the first axle. The first outer race may rotate with the first wheel about a first-wheel first rotational axis. The first axle may extend through the first inner race. The first axle may be spaced apart from the first inner race. The first wheel may rotate about a first-wheel second rotational axis aligned with the first rod.

The wheeled sports device may also include a second wheel assembly with a second wheel, a second axle, a second bearing coupled with the second wheel that has a second inner race and a second outer race, and a second rod extending through an opening in the second axle. The second outer race may rotate with the second wheel about a second-wheel first rotational axis. The second axle may extend through the second inner race. The second axle may be spaced apart from the inner race. The second wheel may rotate about a second-wheel second rotational axis aligned with the second rod.

BRIEF DESCRIPTION OF THE DRAWINGS

These and other features, aspects, and advantages of the present disclosure are better understood when the following Detailed Description is read with reference to the accompanying drawings.

DETAILED DESCRIPTION

Figure 1:
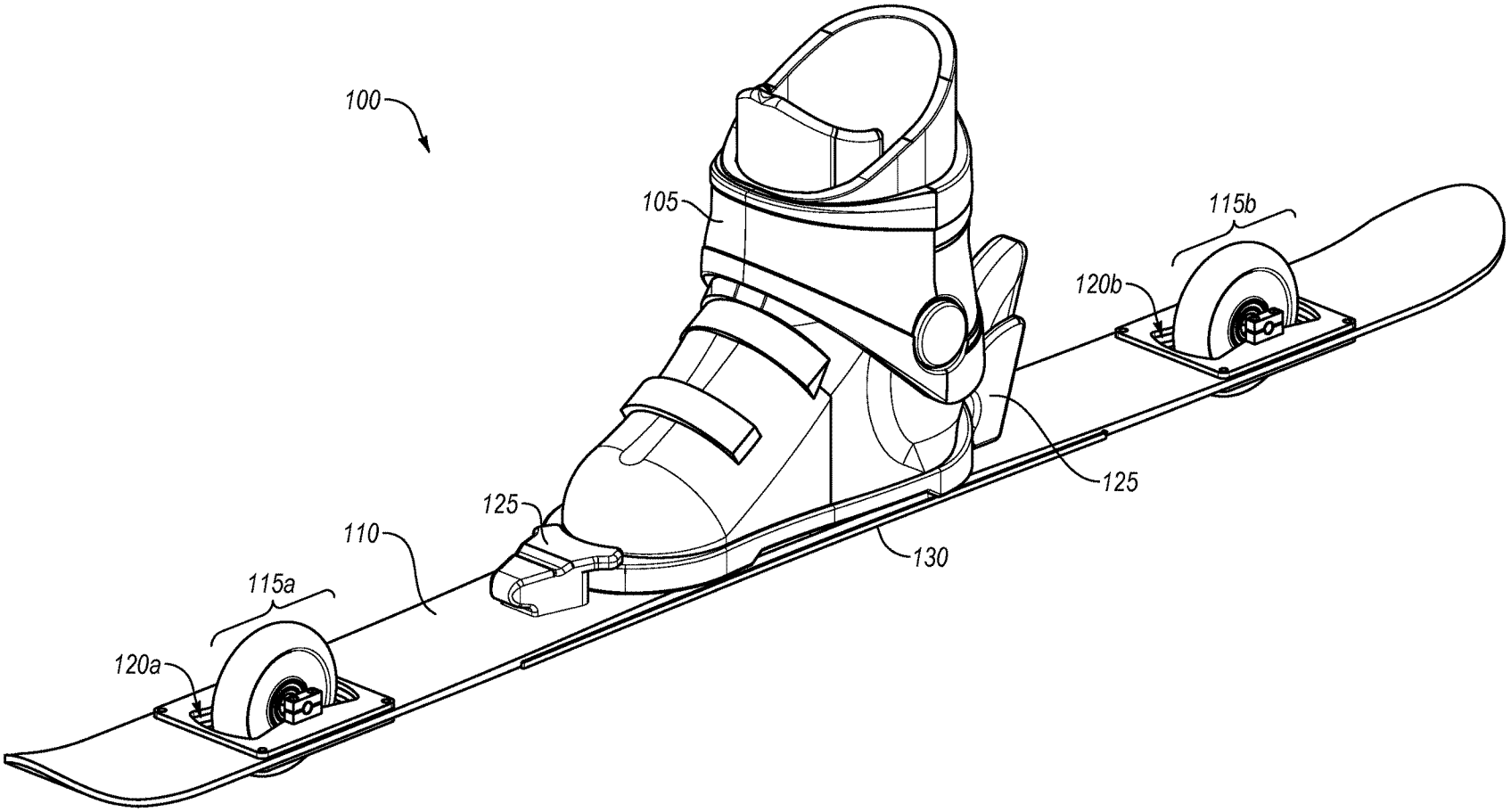
FIG. 1 is an upper perspective view of an example wheeled ski removably coupled with a ski boot according to some embodiments described in this document.

Some embodiments of the present invention are generally directed towards a wheeled ski.

A wheeled ski, for example, may have a variety of shapes, sizes, configurations, and/or arrangements. In some embodiments, a wheeled ski may include any suitable number and combination of features, components, aspects, and the like. Additionally or alternatively, while the wheeled ski shown in the accompanying figures are illustrated as having particular styles, it will be appreciated that the wheeled ski may have any suitable style or configuration.

Additionally or alternatively, to assist in the description of various example embodiments of the wheeled ski, terms such as top, bottom, front, rear, sides, right, and left are used to describe the accompanying figures. These terms are generally used in reference to the figures. Moreover, the drawings are not necessarily, drawn to scale. The wheeled ski, for example, may be disposed in a variety of desired positions or orientations, and used in numerous locations, environments, and arrangements. A detailed description of example embodiments of the wheeled ski now follows. One or more wheel assemblies of the wheeled ski may be used, for example, on other devices.

In some embodiments, a wheeled ski may include an axle that is spaced apart from an inner race of a bearing, which may allow a wheel to rotate about an axis coplanar with the axle and/or rotate around another axis aligned with a rod extending through the axle.

Some embodiments include a wheeled ski with one or two wheels that may not be rotatable or about only a single axis and may not be rigidly fixed to the wheeled ski pointing in a forward direction. In some embodiments, the wheels may be able to spin about one axis and rotate around another possibly orthogonal axis. Wheels that are rotatable about an orthogonal axis to the axle may allow the wheeled ski to form concentric arcs on the pavement.

Some embodiments include a wheeled ski that may include features that intake the function of a sidecut of a snow ski. A sidecut refers to an arcing, hourglass-like curve that may run along a snow ski's edges from the snow ski's tip to its tail. The curve or shape of a snow ski, for example, may dictate the amount of sidecut a snow ski has. For example, a snow ski with a deep sidecut may include a substantially narrow waist compared to its tips, while a snow ski with little or straighter sidecut may include a waist with substantially the same width as its tips. Sidecut may dictate how snow skis turn; a deeper sidecut may facilitate tighter turns. By engaging the sidecut of the snow ski with the snow during a turn, a skier may more easily turn. For example, the sidecut of the snow ski may engage the snow as the skier first tips the ski to increase the ski's edge angle to the snow and then progressively increases pressure on the snow ski, resulting in more bend in the ski. A stiffer or less flexible snow ski may make it more difficult for the skier to initiate the turn, as it may require more force from the skier to allow the sidecut to touch the ground, and the ski to form an arc. The sidecut of the snow ski may allow the skier to create arcs rather than scrubbing the edges across the snow during a turn. Thus, the sidecut of the snow ski may allow the skier to control his or her speed by using the ski to create arcs rather than scrubbing speed by scrubbing the edges across the snow.

In some embodiments, a wheeled ski may include a front wheel and a rear wheel that may each pivot about a pivot axis. The pivot axis, for example, may include a rod about which the wheel may rotate. The pivot axis, for example, may be generally vertical when a flexible member of the wheeled ski is not in use. In some embodiments, the pivot axis may be generally perpendicular with respect to a ground surface when the flexible member is not in use. In some embodiments, the pivot axis may be generally perpendicular to a spin axis of the wheel. In some embodiments, the pivot axis may be generally perpendicular to the axle. In some embodiments, when weight is applied to the flexible member of the wheeled ski, the angle of the pivot axis with respect to the ground surface may change. For example, the angle of the pivot axis may be raked inwardly towards a waist or middle portion of the wheeled ski when weight is applied to the flexible member of the wheeled ski. The degree to which the angle of the pivot axis changes with respect to the ground may be determined, at least in part, by the amount of flex in the flexible member and a weight of a user. In some embodiments, the change in the angle of the pivot axis may introduce a steering geometry into the wheeled ski. In some embodiments, when the angle of the pivot axis is raked inwardly and/or angled with respect to the ground surface, the wheel may pivot around the rod in response to a user initiating a turn.

In some embodiments, the front wheel and rear wheel may pivot around their respective pivot axis in opposite directions. Thus, in some embodiments, the wheels of the wheeled ski may form concentric arcs on the pavement, or arcs having the same center. In some embodiments, the flex in the flexible member and the angle of the rods with respect to the ground surface may allow the wheels to pivot during a turn to simulate the function and feel of the sidecut of the snow ski. In some embodiments, this may allow the wheeled ski to avoid scrubbing of the wheels across the ground surface and to facilitate turning.

In some embodiments described herein, the wheels may have a generally spherical profile, a disc-shaped profile, an elliptical profile, or any other suitable profile shape. In some embodiments, the design of the wheeled ski may require less deformation of the wheels when turning and may allow use of wheels with spherical or flatter profiles, which may provide the wheels greater contact with the ground surface.

FIG. 1 is an upper perspective view of an example wheeled ski 100 removably coupled with a ski boot 105, according to some embodiments described in this document. In some embodiments, the wheeled ski 100 may include a flexible member 110. In some embodiments, the flexible member 110 may include a longitudinal length and front and rear portions with respect to the longitudinal length. In some embodiments, the flexible member 110 may be generally flat along its longitudinal length. In some embodiments, the flexible member 110 may include an upwardly pointing tip on one or more of its ends.

In some embodiments, the wheeled ski 100 may include two wheel assemblies 115*a*, 115*b*. In some embodiments, the wheel assembly 115*a* may be attached to the front portion of the flexible member 110, and the wheel assembly 115*b* may be attached to the rear portion of the flexible member 110. In some embodiments, the wheel assembly 115*a* may be disposed within an aperture 120*a* of the flexible member 110, and the wheel assembly 115*b* may be disposed within aperture 120*b* of the flexible member 110.

In some embodiments, the wheeled ski 100 may include a binding 125, which may be mounted to the flexible member 110. In some embodiments, the binding 125 may be designed to receive the ski boot 105, so that a user's foot may be secured to the wheeled ski 110. In some embodiments, the binding 125 may be a conventional downhill or cross-country ski binding or another kind of binding. In some embodiments, the wheel assemblies 115*a*, 115*b* may be disposed forwardly and rearwardly, respectively, of the binding 125.

The shape of the flexible member 110 may be any suitable shape, such as, for example, a shape similar to that of a conventional snow ski. In some embodiments, the shape of the flexible member 110 may be parabolic. In some embodiments, the shape of the flexible member 110 may provide ground clearance as the wheeled ski 100 carves or turns on a ground surface. The length of the flexible member 110 may be any suitable length, such as, for example, between twenty centimeters and two hundred fifty centimeters.

In some embodiments, the flexible member 110 may be constructed from metal, wood, plastic, a composite material, combinations thereof, or any other suitable material capable of flexing and supporting the weight of a user. In some embodiments, the flexible member 110 may be constructed from a material used to construct conventional snow skis. In some embodiments, the flexible member 110 may be constructed from a material that makes the flexible member 110 stiffer than conventional snow skis. In some embodiments, when a user carves through a center of a first turn and prepares to make a second turn in an opposite direction, the flexible member 110 may provide spring to facilitate the user's shift in weight.

In some embodiments, the flexible member 110 may include one or more rails 130 along all or a portion of one or more edges of the longitudinal length of the flexible member 110. In some embodiments, the rails 130 may be disposed on one or both edges of the flexible member 110. In some embodiments, the rails 130 may be disposed along the longitudinal length of the flexible member 110. In some embodiments, the rails 130 may be disposed on a bottom surface of the flexible member 110. In some embodiments, the rails 130 may be disposed along all or a portion of the longitudinal length of the flexible member 110. In some embodiments, the rails 130 may act as slowing or stopping mechanisms. For example, when a user turns, the rails 130 may contact the ground surface and slow the wheeled ski 100. The rails 130 may protect the flexible member 110 from damage. In some embodiments, the rails 130 may not touch the pavement when the wheeled ski 100 is in use and traveling forward in a straight line or not turning. However, in some embodiments, the rails 130 may touch the pavement as a user of the wheeled ski 110 carves through a center of a turn and applies a force to flex the flexible member 110. In some embodiments, the rails 130 may touch the pavement when the flexible member 110 is flexed to its maximum capacity or close to its maximum capacity.

In some embodiments, the flexible member 110 may include one or more small wheels along all or a portion of the one or more edges of the longitudinal length of the flexible member 110. In some embodiments, the small wheels may be disposed on one or both edges of the flexible member 110. In some embodiments, the small wheels may act as slowing or stopping mechanisms. In some embodiments, the small wheels may be disposed on the bottom surface of the flexible member 110. In some embodiments, the small wheels may be constructed of a hard, low-friction plastic or similar material. In some embodiments, each of the small wheels may include one or more bearings, and each of the bearings may include an inner race. In some embodiments, an inner race of a bearing of a small wheel may directly contact an axle and may not be spaced apart from the axle. In some embodiments, the small wheels may include a spin axis but may not include a second rotational axis. In some embodiments, the small wheels may scrub across pavement to slow the wheeled ski 100 as the wheeled ski 100 turns on the pavement. In some embodiments, the small wheels may not touch the pavement when the wheeled ski 100 is in use and traveling forward in a straight line or not turning. However, in some embodiments, the small wheels may touch the pavement as a user of the wheeled ski 110 carves through a center of a turn and applies a force to flex the flexible member 110. In some embodiments, the small wheels may touch the pavement when the flexible member 110 is flexed to its maximum capacity or close to its maximum capacity.

Figure 2:
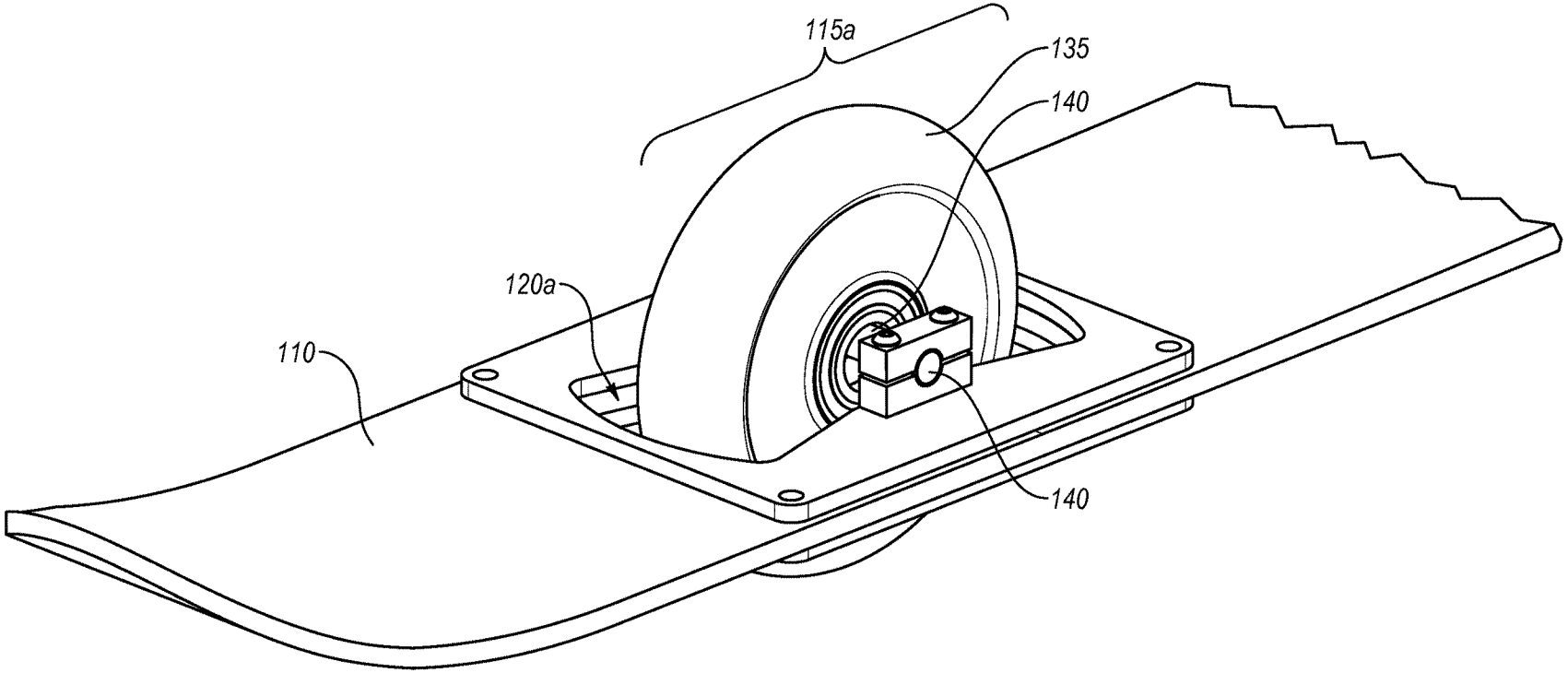
FIG. 2 is an upper perspective view of a front portion of the wheeled ski shown in FIG. 1.

FIG. 2 is an upper perspective view of a front portion of the wheeled ski shown in FIG. 1, according to some embodiments described in this document. In some embodiments, the wheel assembly 115*a* may include a wheel 135. In some embodiments, the wheel 135 may be positioned or affixed to the flexible member 110 to extend through an aperture 120*a* in the flexible member 110. In some embodiments, a portion of the wheel 135 may extend above the aperture 120*a*. In some embodiments, a portion of the wheel 135 may extend below the aperture 120*a*. In some embodiments, a larger portion of the wheel 135 may be disposed above the aperture 120*a* than below the aperture 120*a*.

The wheel assembly 115*a* may also include an axle 140. The axle 140 may be coupled to the flexible member 110. Coupling may include using mounting, fixing, embedding, attaching or any other suitable means of coupling. In some embodiments, the axle 140 may be coupled to a surface of the flexible member 110. In some embodiments, the axle 140 may be coupled to an upper surface of the flexible member 110, as illustrated in FIG. 2. In some embodiments, the axle 140 may be coupled to a lower surface of the flexible member 110. In some embodiments, the axle 140 may be disposed generally perpendicular to the longitudinal axis of the flexible member 110. In some embodiments, the axle 140 may extend across the aperture 120*a* of the flexible member 110.

In some embodiments, the axle 140 may be rigid. In some embodiments, the axle 140 may be constructed of metal or any other suitable material that allows the axle 140 to be rigid. In some embodiments, the axle 140 may include a longitudinal length that is straight or generally straight.

Figure 3:
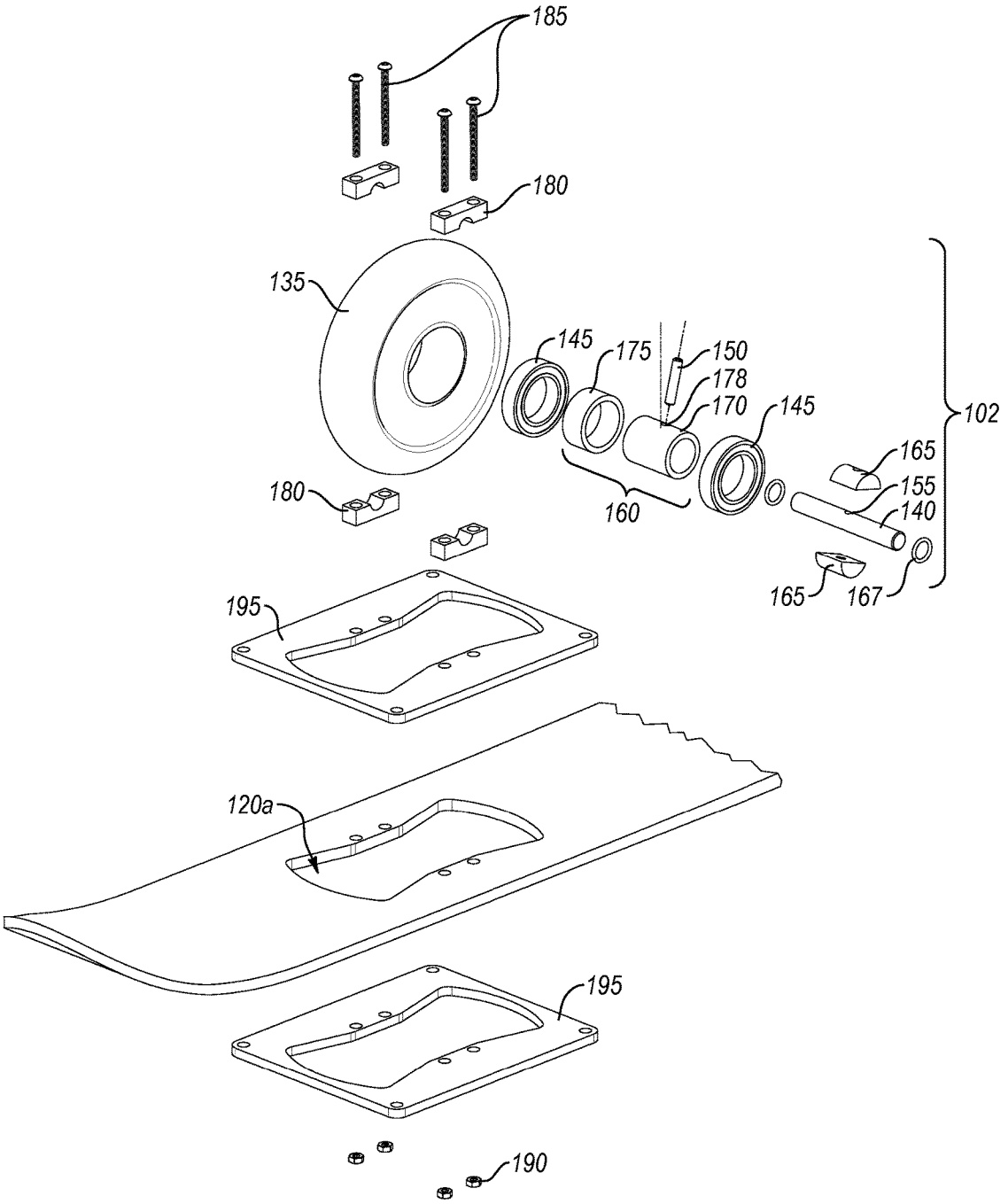
FIG. 3 is an exploded view of the front portion of the wheeled ski shown in FIG. 2.

FIG. 3 is an exploded view of the front portion of the wheeled ski 100 shown in FIG. 2, according to some embodiments described in this document. In some embodiments, the wheel assembly 115*a* may include one or more bearings 145 that may be coupled with the wheel 135. As illustrated in FIG. 3, in some embodiments, the wheel assembly 115*a* may include two bearings 145. In some embodiments, the bearings 145 may include ball bearings, radial ball bearings, or any other suitable bearing. In some embodiments, the bearings 145 may be, for example, a 6800 series or another suitable series. In some embodiments, the bearings 145 may have an inner diameter of twenty millimeters or another suitable inner diameter. Various other diameters may be used.

In some embodiments, the bearings 145 may include an inner race and an outer race. In some embodiments, the outer race may rotate with the wheel 135 about an axis coplanar with the axle 140. In some embodiments, the axle 140 may extend through the inner race of the bearing 145 and may be spaced apart from the inner race of the bearing 145. In some embodiments, the outer race of the bearing 145 may be part of a hub of the wheel 135 or formed in a ring fitted into the hub of the wheel 135.

As illustrated in FIG. 3, in some embodiments, the wheel assembly 115*a* may also include a rod 150 that may extend through an opening 155 in the axle 140. In some embodiments, all or a portion of the rod 150 may be cylindrical, polygonal, rectangular, or have any other shape. In some embodiments, the rod 150 may extend through the opening 155 in the axle 140 in a slip-fit manner. In some embodiments, a portion of the rod 150 that extends through the opening 155 in the axle 140 may be cylindrical, and the opening 155 in the axle 140 may be cylindrical, which may allow the rod 150 to rotate within the opening 155 of the axle 140.

In some embodiments, when the flexible member 110 is not in use, the rod 150 may be disposed with an angle relative to the longitudinal length of the flexible member 110 that is perpendicular, or generally perpendicular. For example, the rod 150 may be disposed with an angle between negative twenty and positive twenty degrees of a line perpendicular to longitudinal length of the flexible member 110. An angle of the rod 150 with respect to the longitudinal length of the flexible member 110 and/or axle 140 may remain constant when the flexible member 110 is flexed. The axle 140 may be spaced apart from the inner race of the bearing 145 and/or spacer 160 by the rod 150 and one or more bushings 165. For example, an outer perimeter or circumference of the axle 140 may be smaller than an inner perimeter or circumference of the inner race of the bearing 145 and/or spacer 160, which may allow the wheel 135 to have at least two degrees of freedom. For example, the wheel 135 may include a first rotational axis (a spin axis) and a second rotational axis (a pivot axis). The wheel 135 may rotate (or spin) around the first rotational axis and the second rotational axis at the same time.

In some embodiments, the first rotational axis of the wheel may be coplanar with the axle 140. In some embodiments, when the wheeled ski 100 is traveling forward is a straight line and not turning, the first rotational axis of the wheel may be aligned with the axle 140. The second rotational axis may be aligned with the rod 150. In some embodiments, the first rotational axis and the second rotational axis may be oriented orthogonally relative to one another. In some embodiments, the wheel 135 may rotate (or spin) freely about the first rotational axis. For example, the wheel 135 may rotate at least one full rotation about the first rotational axis. In some embodiments, the wheel 135 may have limited rotation about the second rotational axis. In some embodiments, the wheel 135 may rotate about the second rotational axis until the inner race of the bearing 145 and/or spacer 160 contacts the axle 140, preventing the wheel 135 from further rotation about the second rotational axis. For example, the wheel 135 may pivot about the second rotational axis at any angle between negative ninety degrees and positive ninety degrees, such as, for example, between approximately negative twenty-five degrees and approximately positive twenty-five degrees. In a specific embodiment, the wheel 135 may pivot about the second rotational axis between approximately negative fifteen degrees and approximately positive fifteen degrees. In some embodiments, the axle 140 may be cylindrical in order to maximize the angle the wheel 135 may pivot around the second rotational axis. In some embodiments, the axle may include one or more indentations to maximize the angle the wheel 135 may pivot around the second rotational axis. In some embodiments, the wheel 135 may rotate about the second rotational axis until the inner race of the bearing 145 and/or spacer 160 contacts one of the indentations in the axle 140. In some embodiments, the indentations may be disposed on opposite sides of the axle 140 and may be disposed where the axle 140 contacts the bearing 145 and/or spacer 160 as it rotates about the second rotational axis.

In some embodiments, the wheel assembly 115*a* may also include one or more bushings 165. The bushings 165 may be disposed between the axle 140 and the inner race of the bearing 145, and the rod 150 may extend through holes in the bushings 165. In some embodiments, the bushings 165 may surround at least a portion of the rod 150 and may prevent the axle 140 from sliding along the rod 150 in an upwards and/or downwards direction. In some embodiments, the bushings 165 may keep the axle 140 suspended at least proximate a center of the bearing 145 so that a central portion of the axle 140 does not sit on or contact the inner race of the bearing 145. In some embodiments, the wheel assembly 115*a* may include a first bushing 165, which may be disposed between the axle 140 and a lower portion of the inner race of the bearing 145, at least proximate a lower portion of the rod 150. In some embodiments, the wheel assembly 115*a* may include a second bushing 165, which may be disposed between the axle 140 and an upper portion of the inner race of the bearing 145, at least proximate a upper portion of the rod 150. The bushing(s) 165 may be constructed from plastic, metal, a composite material, brass, bronze, teflon, or any other suitable material with a low coefficient of friction and capable of providing support. In some embodiments, the bushings 165 may allow the rod 150 to freely pivot within the opening 155 of the axle 140. In some embodiments, at least a portion of the bushings 165 may be round in order to fit in the inner race of the bearing 145 and/or the spacer 160, as will be described later in more detail.

In some embodiments, the wheel assembly 115*a* may include one or more O-rings 167. The O-rings 167 may be fitted around an outer circumference or perimeter of the axle 140. In some embodiments, the inner circumference or perimeter of the O-rings 167 may be approximately equal to an outer circumference or perimeter of the axle 140. In some embodiments, the O-rings 167 may allow the bearings 145 and/or the spacer 160 to move freely relative to the axle 140. In some embodiments, the O-rings 167 may dampen oscillations and/or reduce vibration. In some embodiments, the O-rings 167 may be constructed of rubber or any other suitable material.

In some embodiments, the wheel assembly 115*a* may also include a spacer element, such as, e.g., the spacer 160. In some embodiments, the inner races of two bearings 145 may rest on the spacer 160. In some embodiments, the spacer 160 may secure the two bearings 145 in alignment. In some embodiments, the axle 140 may extend through a center of the spacer 160 and may be spaced apart from the spacer 160 by one or more bushings 165 disposed around a circumference of the rod 150. In some embodiments, the axle 140 may be coupled with the bearings 145 by the spacer 160.

In some embodiments, the spacer 160 may include a first piece 170 and a second piece 175. In some embodiments, the spacer 160 may be configured to couple a first and second end of the rod 150 to the spacer 160, which may include attaching, fitting, mounting, or any other suitable means of coupling. For example, the first and second ends of the rod 150 may be disposed in an upper and lower hole, respectively, in the first piece 170, and the second piece 175 may slip over the first piece 170 to cover the upper and lower holes and secure the rod 150 to the spacer 160. Thus, in some embodiments, the rod 150 may be rigidly held in place by the spacer 160. In some embodiments, the first and second pieces 170, 175 of the spacer 160 may be integrally formed into a single piece.

In some embodiments, the spacer 160 may include a single piece, and a first and second end of the rod 150 may extend respectively through an upper and lower threaded hole in the spacer 160. The first and second ends of the rod 150 may be threaded, and may be attached to the spacer 160 by a threaded or screw-type connection, which may allow the rod 150 to be easily secured to the spacer 160.

In some embodiments, the spacer 160 may be divided transversely into two halves including an upper piece and a lower piece. The upper piece and the lower piece may each include a notch or a hole that may hold a first and second end of the rod 150, respectively. The rod 150 may be sandwiched between the upper piece and lower piece and held securely in place between the upper and lower piece. In some embodiments, the O-rings 167 may be held in place by channels in the upper piece and lower piece. In some embodiments, the bearings 145 may be fixedly coupled to the spacer 160 by circlips or any other suitable means of coupling, and the axle 140 may extend through a center of the upper and lower pieces. In some embodiments, the rod 150 may be rigidly fixed to the axle 140 or the axle 140 and the rod 150 may be integrally formed, and the rod 150 may rotate in the notches or holes in the upper piece and the lower piece of the spacer 160.

In some embodiments, the rod 150 may be oriented perpendicularly with respect to the axle 140. As illustrated in FIG. 3, in some embodiments, the rod 150 may be oriented generally perpendicularly with respect to the axle 140, such as, for example, between negative twenty and positive twenty degrees of a line perpendicular to the axle 140. In a specific embodiment, the rod 150 may be oriented generally perpendicularly with respect to the axle 140, such as, for example, between negative three and three degrees of a line perpendicular to the axle 140.

In some embodiments, the axle 140 may be disposed transverse to the longitudinal length of the flexible member 110 and/or parallel to the ground surface in contact with the wheel 135. In some embodiments, the angle of the rod 150 with respect to the axle 140 may be adjusted or preset prior to use of the flexible member 110. In some embodiments, the angle of the rod 150 with respect to the axle 140 may be adjusted depending on, for example, steering characteristics preferred by a user.

In some embodiments, the opening 155 in the axle 140 may be disposed vertically in a body of the axle 140, which may allow the rod 150 to be oriented perpendicular to the axle 140. In some embodiments, the opening 155 in the axle 140 may be angled, which may allow the rod 150 to be oriented generally perpendicular to the axle 140. The opening 155 in the axle 140 may be angled between, for example, negative twenty and positive twenty degrees of a line perpendicular to the longitudinal length of the axle 140. In a specific embodiment, the opening 155 in the axle 140 may be angled between, for example, negative three and positive three degrees of a line perpendicular to the longitudinal length of the axle 140. A hole 178, opening, or notch in the spacer 160 may be disposed at the same angle as the opening 155 in the axle 140.

In some embodiments, the opening 155 in the axle 140 may be disposed vertically in the body of the axle 140, and the axle 140 may be rotated in one or more clamps 180 in order to change the orientation of the rod 150 with respect to the axle 140 and/or secure the axle 140 to the flexible member 110. In some embodiments, the opening 155 in the axle 140 may be disposed vertically in the body of the axle 140, and an angle corresponding to a desired angle of the rod with respect to a longitudinal axis of the axle may be machined into an edge of the axle 140 where the axle 140 meets the clamp 180 and/or flexible member 110 so that the axle is mounted with the edge disposed on the clamp 180 and/or flexible member 110 and disposed at an angle rather than mounted squarely on the clamp 180 and/or flexible member 110. In some embodiments, the clamps 180 may secure the axle 140 to the flexible member 110 using one or more screws, bolts 185, nuts 190, or any other suitable attachment mechanism. The clamps 180 may be used to mount the axle 140 to the flexible member 110 in a desired position. In some embodiments, the clamps 180 may include radial markings to indicate to a user how much to rotate the axle 140 within the clamps 180 in order to position the rod 150 a certain number of degrees from a line perpendicular to the longitudinal length of the axle 140.

In some embodiments, one or more plates 195 may be placed above and/or below the flexible member 110. At least one plate 195 may be disposed between the clamps 180 and the flexible member 110. The bolts 185 and nuts 190 may couple the clamps 180 and plates 195 to the flexible member 110.

In some embodiments, the wheel assembly 115*b* may be constructed in a similar or identical manner as the wheel assembly 115*a*.

Figure 4:
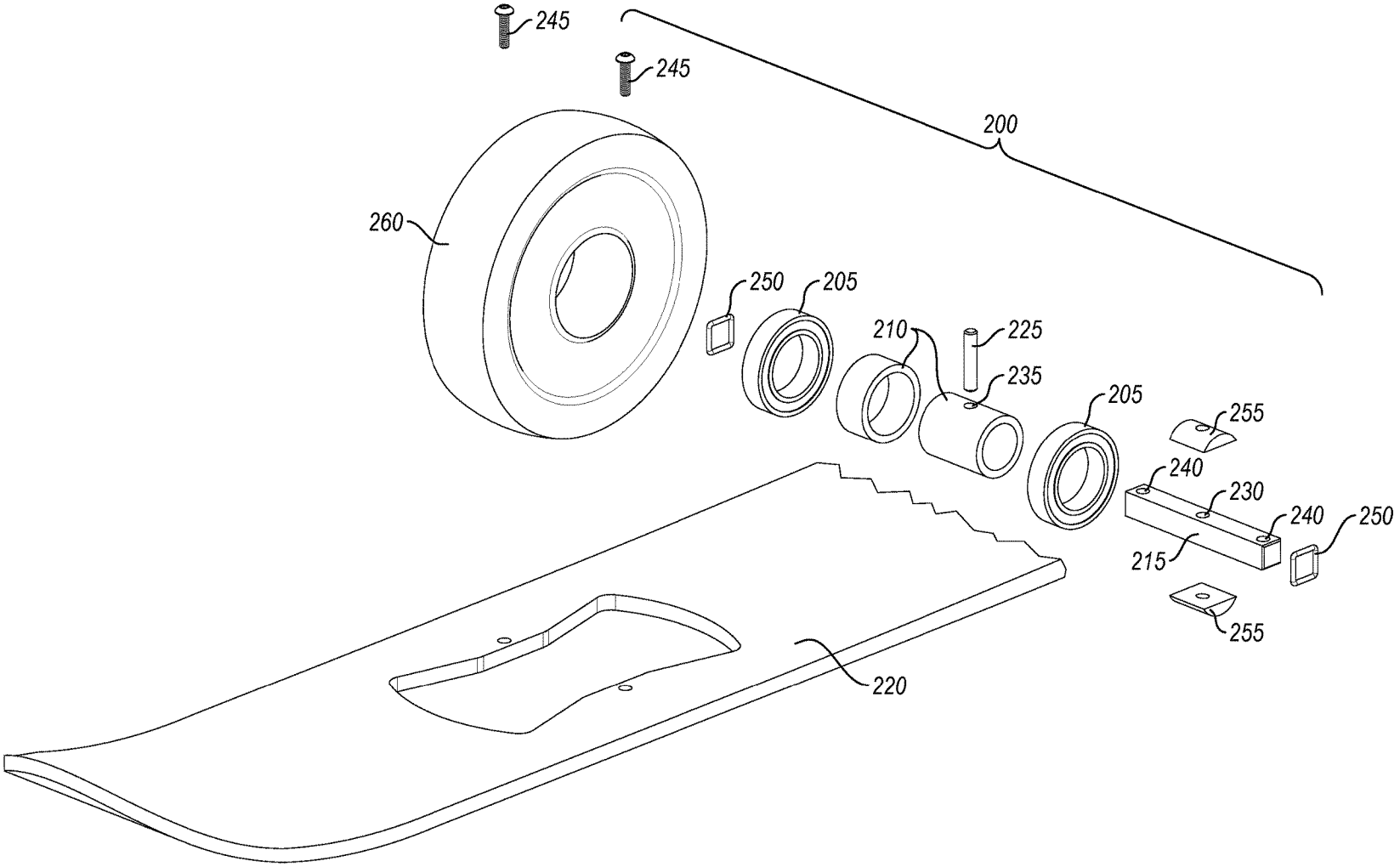
FIG. 4 is an exploded view of a front portion of another example wheeled ski according to some embodiments described in this document.

FIG. 4 is an exploded view of a portion of another example wheeled ski, according to some embodiments described in this document. The portion of the wheeled ski may include a wheel assembly 200. As illustrated in FIG. 4, a bearing 205 and/or spacer 210 may not directly contact the axle 215 or may be spaced apart from the axle 215. In some embodiments, the axle 215 may include a variety of circular or non-circular cross sectional shapes, such as, for example, square, polygonal, rectangular, etc.

As illustrated in FIG. 4, in some embodiments, a rod 225 may be oriented perpendicularly with respect to the axle 215, and an opening 230 in the axle 215 may be disposed vertically in a body of the axle 215. In some embodiments, a hole 235, opening, or notch in the spacer 210 may be disposed perpendicular to a longitudinal length of the axle to correspond with the opening 230 in the axle 215. In some embodiments, the axle 215 may include one or more additional openings 240. In some embodiments, screws 245, bolts, or any other suitable attaching means may extend through the additional openings 240 to couple the axle to the flexible member 220. In some embodiments, the screws 245 may fixedly couple the axle 215 to the flexible member 220, such that the axle 215 does not move.

In some embodiments, one or more O-rings 250 may be fitted around an outer perimeter of the axle 215. In some embodiments, in response to the axle 240 being square-shaped, the O-rings 250 may also be square-shaped. Although two bushings 255 are illustrated in FIG. 4, in some embodiments, a single bushing 255 may be used.

In some embodiments, wheel assembly 200 may include the bearings 205, the spacer 210, the axle 215, the rod 225, the opening 230 in the axle 215, the opening 235 in the spacer 210, the O-rings 250, the bushings 255, and/or a wheel 260, which may correspond to the bearings 145, the spacer 160, the axle 140, the rod 150, the opening 155 in the axle 140, the opening 178 in the spacer 160, the O-rings 153, the bushings 165, and/or the wheel 135 of FIG. 3, respectively. In some embodiments, the wheel assembly 200 may correspond to the wheel assembly 115*a*.

With combined reference to FIGS. 3 and 4, a wheel 135 with a disc-like or elliptical profile is illustrated in FIG. 3, while a wheel 260 with a flat or straight profile is illustrated in FIG. 4. In some embodiments, a wheel may have a generally spherical profile (not shown in the Figures). In some embodiments, the generally spherical profile of the wheel may allow a greater surface area of the wheel to contact a ground surface, compared to a wheel with a disc-like profile. In some embodiments, a diameter of a wheel with a spherical profile may be approximately equal to a width of the wheel. In some embodiments, a radius of a wheel with a spherical profile may be approximately equal to a portion of a width of the wheel that contacts a ground surface.

Figure 5:
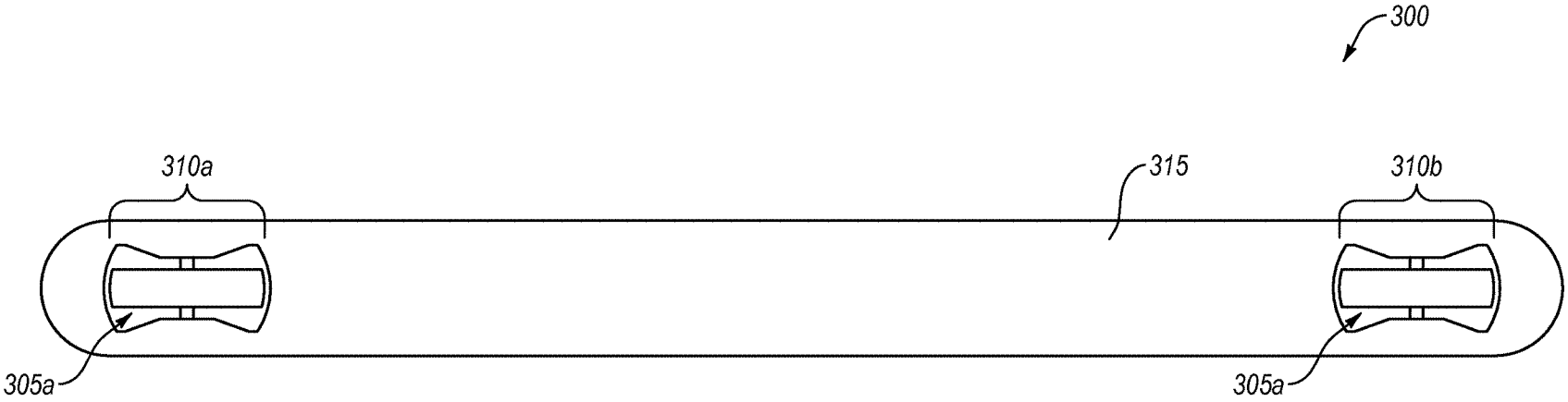
FIG. 5 is a lower perspective view of another wheeled ski according to some embodiments described in this document.

FIG. 5 is a lower perspective view of another wheeled ski 300, according to some embodiments described in this document. In some embodiments, the wheeled ski 300 may correspond to the wheeled ski 100 and/or the wheeled ski 200. FIG. 5 illustrates two apertures 305*a*, 305*b* (e.g., apertures 120*a* and 120*b*), two wheel assemblies 310*a*, 310*b* (e.g., wheel assemblies 120*a*, 120*b*, wheel assembly 200) disposed in the two apertures 305*a*, 305*b*, and a bottom of a flexible member 315 (e.g., flexible member 110, flexible member 220). The wheeled assemblies 310*a* and 310*b*, for example, may include any or all components described in conjunction with wheeled assemblies 115*a*, 200. In some embodiments, the apertures 305*a*, 305*b* may be disposed generally parallel to a longitudinal length of the flexible member 315.

Figure 6:
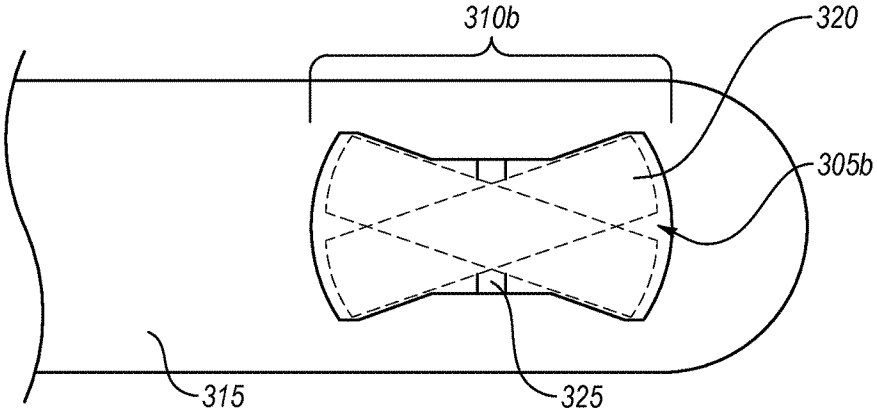
FIG. 6 is an enlarged lower perspective view of a portion of the wheeled ski shown in FIG. 5.

FIG. 6 is an enlarged lower perspective view of a portion of the wheeled ski shown in FIG. 5, according to some embodiments described in this document. The wheel 320 is shown in two rotational states rotated about a second axis and shows an example of the rotational range of the wheel 320. In some embodiments, a wheel 320 of the wheel assembly 310*b* may rotate (or spin) about a first axis aligned with an axle 325, as well as rotate around a second axis aligned with a pivot point extending through the axle 325. In some embodiments. As illustrated in FIG. 6, in some embodiments, the wheel 320 may have limited rotation about the second rotational axis. For example, the wheel 320 may rotate about the second rotational axis aligned with the rod until the inner race of a bearing and/or a spacer contacts the axle 325, preventing the wheel 320 from further rotation about the axis aligned with the rod. In some embodiments, the aperture 305*b* may be shaped to be large enough to allow the bearing and/or spacer of the wheel 320 to contact the axle 325 before contacting a side of the aperture 305*b*. In some embodiments, when the bearing and/or spacer of the wheel 320 contacts the axle 325, one or more sides of the aperture 305*b* may be at least proximate to the wheel 320. In some embodiments, the wheel 135 may pivot about the second rotational axis at any angle between negative ninety degrees and positive ninety degrees, such as, for example, between approximately negative twenty-five degrees and approximately positive twenty-five degrees.

In some embodiments, the wheel assembly 310*a* and aperture 305*a* may be constructed in a similar or identical manner as the wheel assembly 310*b* and aperture 305*b*.

Figure 7:
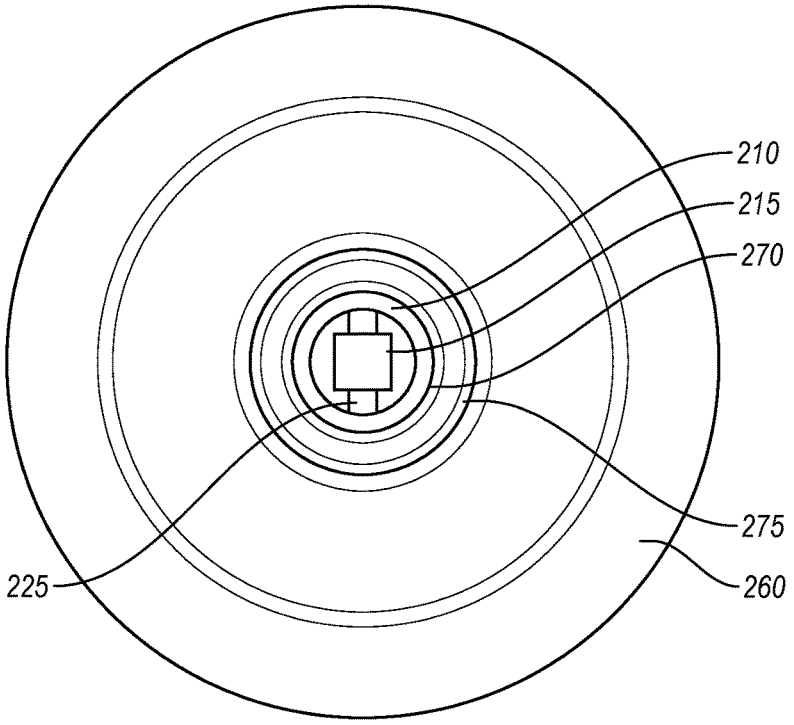
FIG. 7 is a side view of a wheel assembly of the wheeled ski shown in FIG. 4 with bushings and O-rings removed.

FIG. 7 is a side view of the wheel assembly 200 of the wheeled ski shown in FIG. 4 with bushings and O-rings removed, according to some embodiments described in this document. FIG. 4 illustrates the rod 225, the axle 215, the spacer 210, the wheel 260, an inner race 270 of the bearing 205, and an outer race 275 of the bearing 205.

Figure 8:
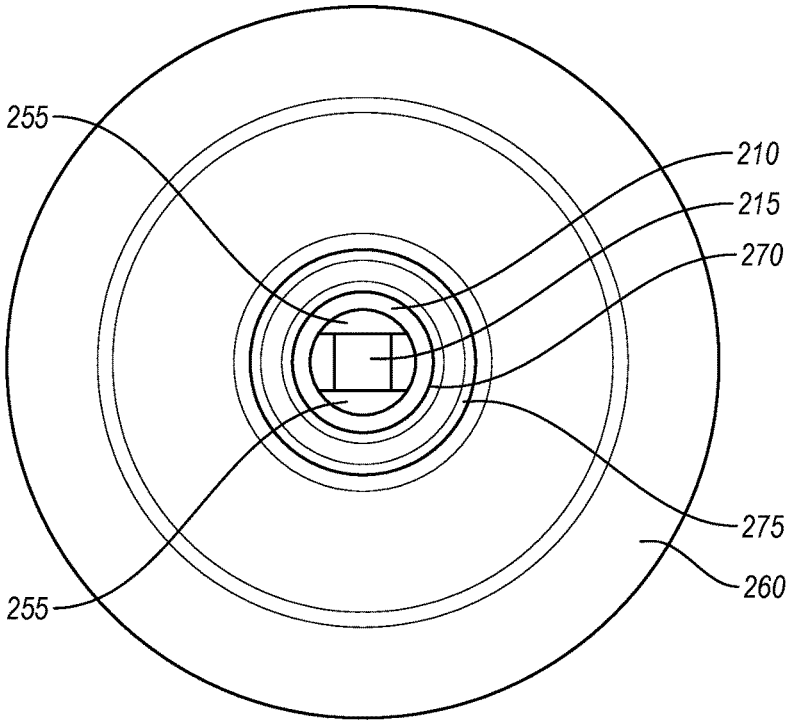
FIG. 8 is a side view of the wheel assembly shown in FIG. 7 with bushings.

FIG. 8 is a side view of the wheel assembly 200 shown in FIG. 7 with bushings 255, according to some embodiments described in this document.

Figure 9:
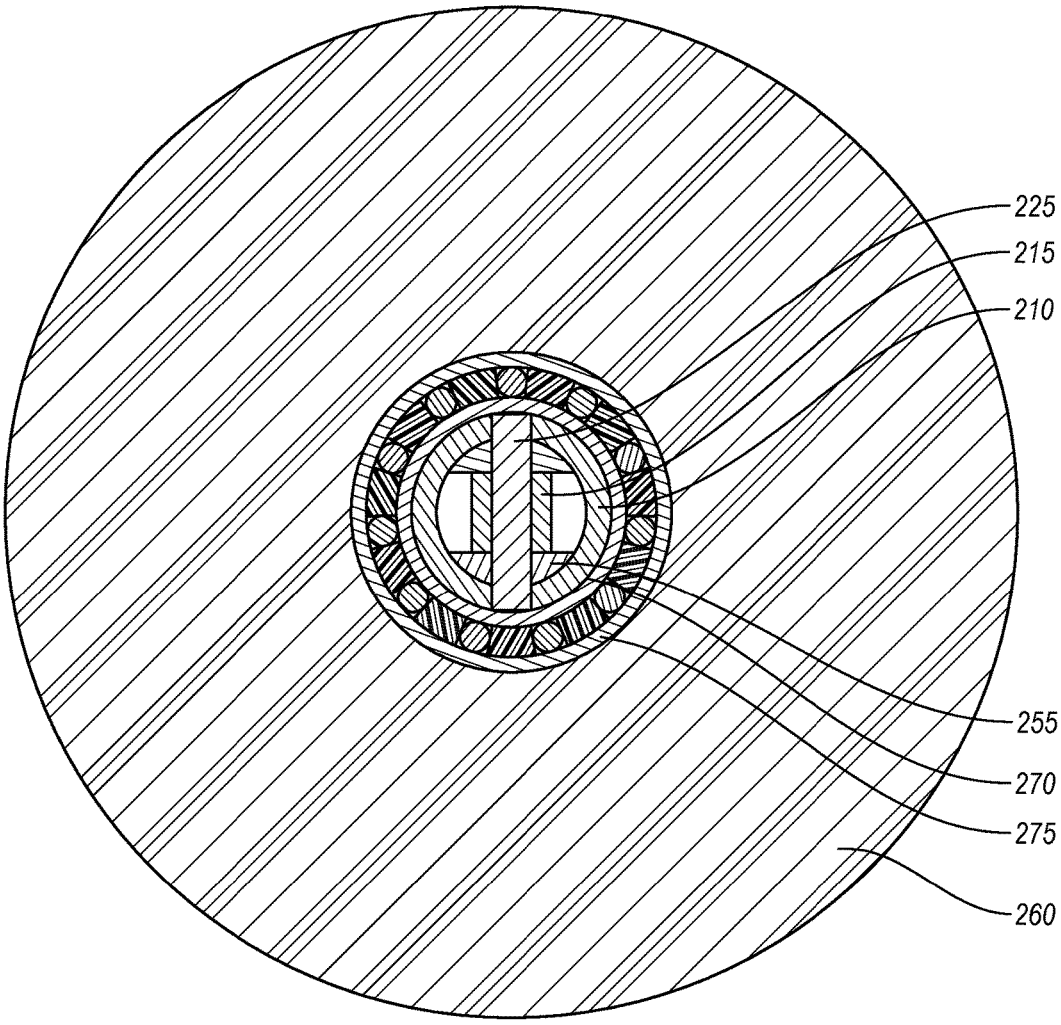
FIG. 9 is a cross sectional side view of the wheel assembly shown in FIG. 7.

FIG. 9 is a cross sectional side view of the wheel assembly 200 shown in FIG. 7 along a center line, according to some embodiments described in this document. FIG. 9 illustrates the rod 225, the axle 215, the spacer 210, the wheel 260, an inner race 270 of the bearing 205, and an outer race 275. As illustrated in FIG. 9, in some embodiments, the rod 225 may be oriented perpendicularly with respect to the axle 215, and an opening 230 in the axle 215 may be disposed vertically in a body of the axle 215 as well as the spacer 210. The rod 225 may be coupled to the spacer 210 and/or the inner race 270 of the bearing 205. The outer race 275 of the bearing 205 may rotate with the wheel 260 around a first rotational axis, while the inner race 270 of the bearing 205, the spacer 210, and the rod 225 are held rigidly in place with respect to the first rotational axis.

Figure 10:
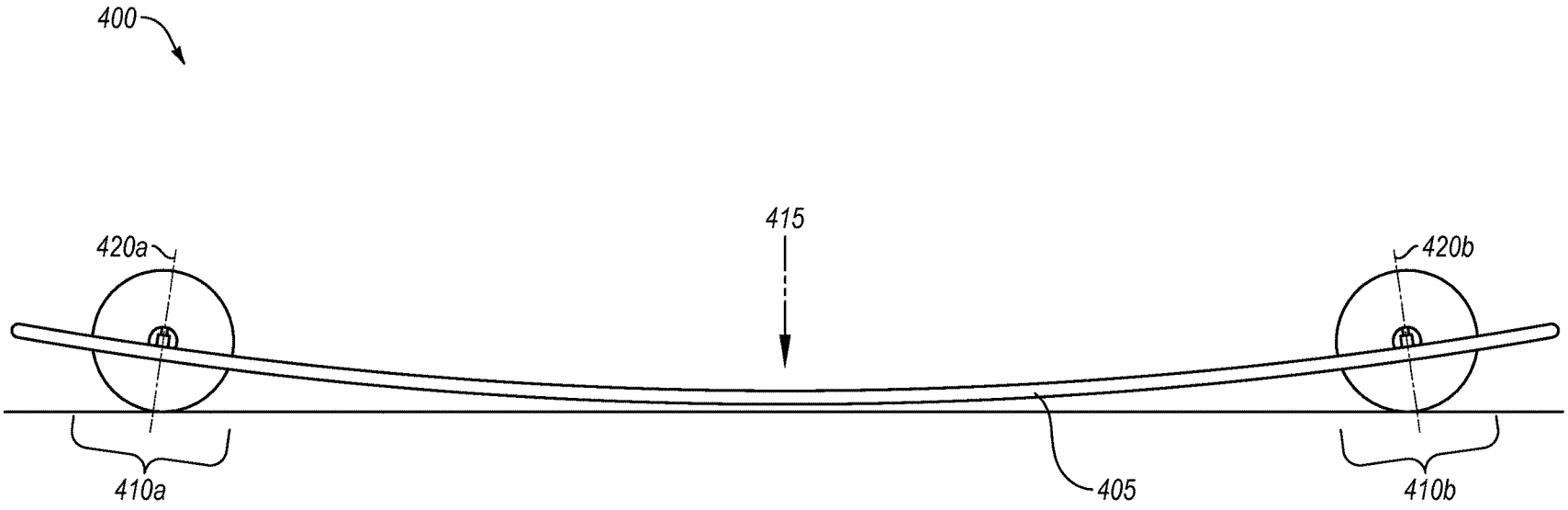
FIG. 10 is a simplified side view of another wheeled ski with a flexed ski member according to some embodiments described in this document.

FIG. 10 is a simplified side view of the wheeled ski 400 with a flexed flexible member 405. In some embodiments, the wheeled ski 400 may correspond to the wheeled ski 100. The wheeled ski 400 may include a front wheel assembly 410*a* and a rear wheel assembly 410*b*, which may be referred to hereinafter as wheel assemblies 410*a*, 410*b*. Wheels of the wheel assemblies 410*a*, 410*b* may include a first rotational axis aligned with an axle and a second rotational axis 420*a*, 420*b* aligned with a rod. In response to the flexible member 405 being flexed by a downward force 415, the second rotational axis 420*a*, 420*b* aligned with rods of the wheel assemblies 410*a*, 410*b* may be raked inwardly, as illustrated, for example, in FIG. 10. In some embodiments, in response to the flexible member 405 being flexed by a downward force 415, the second rotational axis 420*a*, 420*b* aligned with the rods of the wheel assemblies 410*a*, 410*b* may be angled with respect to a ground surface in contact with the wheels of the wheel assemblies 410*a*, 410*b*, and the wheels may pivot around their corresponding rods in opposing directions with respect to each other. Thus, in some embodiments, the wheels of the wheeled ski 400 may form concentric arcs on a ground surface.

Figure 11:
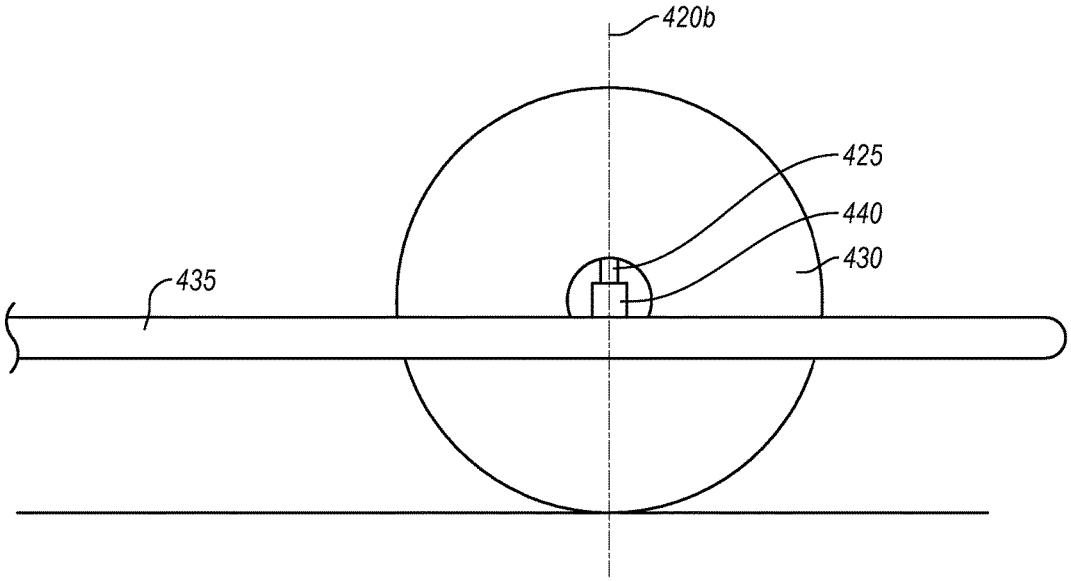
FIG. 11 is a simplified side view of a portion of the wheeled ski shown in FIG. 10 with an unflexed ski member.
Figure 12:
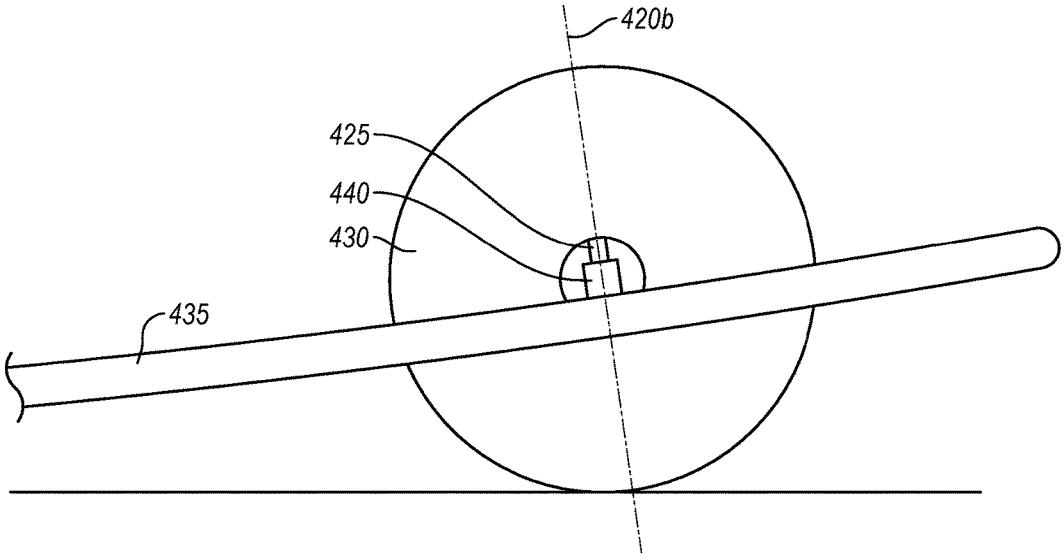
FIG. 12 is a simplified side view of the portion of the wheeled ski shown in FIG. 11 with a flexed ski member.

FIGS. 11 and 12 are simplified side views of a portion of the wheeled ski 400 shown in FIG. 10, according to some embodiments described in this document. The rear wheel assembly 410*b* is illustrated in FIGS. 11 and 12. The front wheel assembly 410*a* may be configured in a manner that is similar or the same as the rear wheel assembly 410*b*. The flexible member 405 is unflexed in FIG. 11 and flexed in FIG. 12. In some embodiments, when a user stands on the flexible member 405, the flexible member 405 may be flexed and an angle of a rod 425 with respect to a ground surface in contact with a wheel 430 may change, yet the angle between the rod and the flexible member 405 does not change. As illustrated, for example, in FIG. 12, In some embodiments, in response to the flexible member 405 being flexed, the second rotational axis 420*b* aligned with the rod 425 may shift or be raked inwardly towards a middle portion 435 of the flexible member 405 or a binding disposed in the middle portion, such as, for example, the binding 105 of FIG. 1. In some embodiments, as a user makes a turn, the user may progressively increase pressure on the flexible member 405, increasingly flexing the flexible member 405 and orienting an angle of the rod 425 increasingly further from a line perpendicular to the ground surface and towards the middle portion 435 of the flexible member 110, which may provide a tighter arc or tighter steering through the turn.

In some embodiments, as illustrated in FIG. 11, when the flexible member 405 is not in use, the rod 425 may be oriented perpendicularly with respect to the axle 440, the longitudinal length of the flexible member 405, and/or a ground surface in contact with the wheel 135. In some embodiments, as illustrated in FIG. 11, when the flexible member 405 is not in use, the rod 425 may be oriented vertically. As illustrated in FIGS. 11 and 12, in some embodiments, an angle of the rod 410 with respect to the longitudinal length of the flexible member 405 and/or axle 440 may remain constant in response to the flexible member 405 being flexed. In some embodiments, an angle of the second rotational axis 420*b* with respect to the longitudinal length of the flexible member 405 and/or axle 440 may remain constant in response to the flexible member 405 being flexed.

When the flexible member 405 is in use and weight is applied to the flexible member 405, an angle of the rod 425 with respect to the ground surface may be dependent on the amount of flex in the flexible member 405, the weight of the user, and/or the hardness of the ground surface.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations, and/or additions to the present subject matter as would be readily apparent to one of ordinary skill in the art.

What is claimed is:

1. A wheeled ski comprising:

a flexible member having a longitudinal axis, a front portion with respect to the longitudinal axis, a rear portion with respect to the longitudinal axis, a front closed aperture, and a rear closed aperture;

a first wheel assembly comprising:

a first wheel disposed within the front closed aperture;

a first axle coupled with the flexible member;

a first bearing coupled with the first wheel having a first inner race and a first outer race, the first outer race rotates with the first wheel about a first-wheel spin axis, wherein the first axle extends through the first inner race; and a first rod extending through an opening in the first axle and coupled with the first bearing, wherein the first wheel rotates about a first axis aligned with the first rod, wherein the front closed aperture is sized and shaped to allow the first wheel to rotate about the first axis between negative fifteen degrees and positive fifteen degrees; and a second wheel assembly comprising:

a second wheel disposed within the second closed aperture;

a second axle coupled with the flexible member;

a second bearing coupled with the second wheel having a second inner race and a second outer race, the second outer race rotates with the second wheel about a second-wheel spin axis, wherein the second axle extends through the second inner race; and a second rod extending through an opening in the second axle and coupled with the second bearing, wherein the second wheel rotates about a second axis aligned with the second rod, wherein the second closed aperture is sized and shaped to allow the second wheel to rotate about the second axis between negative fifteen degrees and positive fifteen degrees.

2. The wheeled ski of claim 1, wherein the first wheel assembly is attached to the front portion of the flexible member, and the second wheel assembly is attached to the rear portion of the flexible member.

3. The wheeled ski of claim 1, wherein the first axle and the second axle are coupled to a surface of the flexible member.

4. The wheeled ski of claim 1, wherein an angle of the first rod with respect to a ground surface in contact with the first wheel changes in response to the flexible member being flexed, wherein an angle of the second rod with respect to a ground surface in contact with the second wheel changes in response to the flexible member being flexed.

5. The wheeled ski of claim 1, wherein the first wheel assembly further comprises one or more first bushings disposed between the first axle and the first inner race, and wherein the first rod extends through at least one of the one or more first bushings; and wherein the second wheel assembly further comprises one or more second bushings disposed between the first axle and the first inner race, and wherein the second rod extends through at least one of the one or more second bushings.

6. The wheeled ski of claim 1, wherein the first wheel rotates about the axis aligned with the first rod until the first inner race or a first spacer element coupled to the first rod contacts the first axle, preventing the first wheel from further rotation about the axis aligned with the first rod; and wherein the second wheel rotates about the axis aligned with the second rod until the second inner race or a second spacer element coupled to the second rod contacts second the axle, preventing the second wheel from further rotation about the axis aligned with the second rod.

7. The wheeled ski of claim 1, wherein an angle of the first rod with respect to the first axle remains constant when the flexible member is flexed; and wherein an angle of the second rod with respect to the second axle remains constant when the flexible member is flexed.

8. A wheeled ski comprising:

a flexible member having a front closed aperture and a rear closed aperture;

a first wheel assembly comprising:

a first wheel disposed at least in part within the front closed aperture, wherein the first wheel comprises a first-wheel first rotational axis and a first-wheel second rotational axis, wherein the first-wheel first rotational axis and the first-wheel second rotational axis intersect, wherein the front closed aperture is sized and shaped to allow the first wheel to rotate about the first-wheel second rotational axis between negative fifteen degrees and positive fifteen degrees; and a second wheel assembly comprising:

a second wheel disposed at least in part within the rear closed aperture, wherein the second wheel comprises a second-wheel first rotational axis and a second-wheel second rotational axis, wherein the second-wheel first rotational axis and the second-wheel second rotational axis intersect, wherein the rear closed aperture is sized and shaped to allow the second wheel to rotate about the second-wheel second rotational axis between negative fifteen degrees and positive fifteen degrees.

9. The wheeled ski of claim 8, wherein the first-wheel first rotational axis and the first-wheel second rotational axis intersect perpendicularly; and wherein the second-wheel first rotational axis and the second-wheel second rotational axis intersect perpendicularly.

10. The wheeled ski of claim 8, wherein the first wheel assembly further comprises:

a first axle coupled with the flexible member; and a first rod that extends through the first axle, wherein the first-wheel second rotational axis is aligned with the first rod; and wherein the second wheel assembly further comprises:

a second axle coupled with the flexible member; and a second rod that extends through the second axle, wherein the second-wheel second rotational axis is aligned with the second rod.

11. The wheeled ski of claim 10, wherein the first axle is disposed generally perpendicularly to a longitudinal axis of the flexible member and is fixed to the flexible member; and wherein the second axle is disposed generally perpendicularly to a longitudinal axis of the flexible member and is fixed to the flexible member.

12. The wheeled ski of claim 10, wherein the first axle extends across a first aperture in the flexible member, and wherein the second axle extends across a second aperture in the flexible member.

13. The wheeled ski of claim 10, wherein an angle of the first rod with respect to the first axle remains constant when the flexible member is flexed; and wherein an angle of the second rod with respect to the second axle remains constant when the flexible member is flexed.

14. The wheeled ski of claim 10, further comprising a first bearing coupled with the first wheel having a first inner race and a first outer race; and a second bearing coupled with the second wheel having a second inner race and a second outer race, wherein the first wheel rotates about the first-wheel second rotational axis until the first inner race or a first spacer element coupled to the first axle contacts the first axle, preventing the first wheel from further rotation about the first-wheel second rotational axis aligned with the first rod; and wherein the second wheel rotates about the second-wheel second rotational axis until the second inner race or a second spacer element coupled to the second axle contacts the second axle, preventing the second wheel from further rotation about the second-wheel second rotational axis aligned with the second rod.

15. The wheeled ski of claim 10, wherein the first rod extends through the opening in the first axle in a slip-fit manner; and wherein the second rod extends through the opening in the second axle in a slip-fit manner.

16. The wheeled ski of claim 8, wherein the first wheel rotates at least one full rotation about the first-wheel first rotational axis, wherein the first wheel has limited rotation about the first-wheel second rotational axis, wherein the second wheel rotates at least one full rotation about the second-wheel first rotational axis, and wherein the second wheel has limited rotation about the second-wheel second rotational axis.

17. The wheeled ski of claim 10, wherein the first rod extends through an opening in the first axle; and wherein the second rod extends through an opening in the second axle.

18. A wheeled sports device comprising:

a substantially flat flexible member comprising an upper surface and a lower surface, and having a front closed aperture and a rear closed aperture, wherein the upper surface and the lower surface are substantially flat, wherein the upper surface and the lower surface have substantially the same surface area, wherein the upper surface and the lower surface are substantially coplanar;

a first wheel assembly coupled with the flexible member comprising:

a first wheel disposed within the front closed aperture;

a first axle;

a first bearing coupled with the first wheel having a first inner race and a first outer race, the first outer race rotates with the first wheel about a first-wheel first rotational axis, wherein the first axle extends through the first inner race, and wherein the first axle is spaced apart from the first inner race; and a first rod extending through an opening in the first axle, wherein the first wheel rotates about a first-wheel second rotational axis aligned with the first rod, wherein the front closed aperture is sized and shaped to allow the first wheel to rotate about the first-wheel second rotational axis between negative fifteen degrees and positive fifteen degrees; and a second wheel assembly coupled with the flexible member comprising:

a second wheel disposed within the back closed aperture;

a second axle;

a second bearing coupled with the second wheel having a second inner race and a second outer race, the second outer race rotates with the second wheel about a second-wheel first rotational axis, wherein the second axle extends through the second inner race; and a second rod extending through an opening in the second axle, wherein the second wheel rotates about a second-wheel second rotational axis aligned with the second rod, and wherein the second axle is spaced apart from the second inner race, wherein the back closed aperture is sized and shaped to allow the second wheel to rotate about the second-wheel second rotational axis between negative fifteen degrees and positive fifteen degrees.

* * * * *